US009789350B1

(12) United States Patent
Wu

(10) Patent No.: US 9,789,350 B1
(45) Date of Patent: Oct. 17, 2017

(54) HEADGEAR FOR NECK REHABILITATION AND WEIGHT TRAINING

(71) Applicant: Yung-Cheng Wu, Tainan (TW)

(72) Inventor: Yung-Cheng Wu, Tainan (TW)

( * ) Notice: Subject to any disclaimer, the term of this patent is extended or adjusted under 35 U.S.C. 154(b) by 36 days.

(21) Appl. No.: 15/163,721

(22) Filed: May 25, 2016

(51) Int. Cl.

| | |
|---|---|
| ***A63B 23/025*** | (2006.01) |
| ***A63B 21/02*** | (2006.01) |
| ***A63B 21/065*** | (2006.01) |
| ***A63B 21/00*** | (2006.01) |
| ***A63B 21/04*** | (2006.01) |

(52) U.S. Cl.
CPC ..... *A63B 21/065* (2013.01); *A63B 21/0442* (2013.01); *A63B 21/4039* (2015.10); *A63B 23/025* (2013.01)

(58) Field of Classification Search
CPC ... A63B 21/06–21/065; A63B 21/40–21/4039; A63B 21/04–21/0442; A63B 23/025; A63B 21/05–21/0557
USPC ..... 482/10, 11, 92, 121–129
See application file for complete search history.

(56) References Cited

U.S. PATENT DOCUMENTS 1,618,273 A * 2/1927 Davidson ..... A63B 21/0004 482/124
3,779,549 A * 12/1973 MacNeil ..... A63B 71/1291 473/208
4,189,141 A * 2/1980 Rooney ..... A63B 23/03 482/105
4,399,994 A * 8/1983 Hourihan ..... A63B 21/0004 473/208
5,324,247 A * 6/1994 Lepley ..... A63B 23/0233 482/112
5,336,139 A * 8/1994 Miller ..... A63B 21/0552 482/10
5,372,565 A * 12/1994 Burdenko ..... A63B 21/0552 482/124
5,507,707 A * 4/1996 Miller ..... A63B 21/0004 482/10
5,545,113 A * 8/1996 Bobich ..... A63B 21/0004 482/124
5,813,954 A * 9/1998 Wilkinson ..... A63B 21/0004 482/124
9,289,641 B2 * 3/2016 Richardson ..... A63B 21/0555
9,421,144 B2 * 8/2016 Kalinowski ..... A61H 3/008
9,498,675 B2 * 11/2016 Balakin ..... A63B 23/025
9,526,965 B2 * 12/2016 Gatherer ..... A63B 71/0054
(Continued)

*Primary Examiner* — Stephen R Crow
*Assistant Examiner* — Garrett Atkinson
(74) *Attorney, Agent, or Firm* — Alan D. Kamrath; Kamrath IP Lawfirm, P.A.

(57) ABSTRACT

A headgear for neck rehabilitation and weight training includes first and second straps forming a loop for wrapping a forehead of a user, an upper strap device abutting a top of a head of the user, and a lower strap abutting a chin of the user. The second strap is coupled to the first strap and is adjustable in length to fit the head circumference of the user. The upper strap device is adjustable in length to fit the spacing between the forehead and the top of the head of the user. The lower strap is coupled to the loop formed by the first and second straps and is adjustable in length to fit the chin of the user. The headgear can be assembled with one of two rehabilitation accessories in a rehabilitation mode or assembled with a weight training accessory in a weight training mode.

10 Claims, 9 Drawing Sheets

(56) References Cited

U.S. PATENT DOCUMENTS

| | | | | |
|---|---|---|---|---|
| 2012/0165169 | A1* | 6/2012 | Gatherer | A63B 71/0054<br>482/139 |
| 2015/0202072 | A1* | 7/2015 | Glazener | A61F 5/02<br>602/18 |
| 2016/0297336 | A1* | 10/2016 | Suomi | B60N 2/4879 |

* cited by examiner

HEADGEAR FOR NECK REHABILITATION AND WEIGHT TRAINING

BACKGROUND OF THE INVENTION

The present invention relates to a headgear for neck rehabilitation and weight training and, more particularly, to a headgear that can be securely worn on a head of a user for proceeding with weight training of the neck by hanging a weight or proceeding with neck rehabilitation by using an elastic cord.

A type of headgear available on the market can be worn on a head of a user and can be attached with a weight to proceed with weight training of the neck of the user by resisting the weight. The headgear generally includes a first portion wrapped around the forehead of the user, a second portion pressing against a top of the head of the user, and a metal chain for hanging the weight. In use, the user twists the head to lift the weight above the ground, achieving a weight training effect of the neck by resisting the weight.

However, only the first portion of the headgear wrapped around the forehead of the user can be adjusted. Namely, the second portion pressing against the top of the head of the user cannot be adjusted. If the user has a small spacing between the forehead and the top of the head, the first portion could blindfold the eyes of the user, leading to inconvenience in use.

BRIEF SUMMARY OF THE INVENTION

A headgear according to the present invention includes a first strap having two connecting ends and inner and outer faces opposite to each other and extending between the two connecting ends. The first strap further includes a first connecting ring fixed to the outer face, a first buckle fixed to the outer face, and first and second engagement rings and fixed to the outer face and located on two sides of the first buckle. The first strap further includes two coupling rings respectively fixed to the two connecting ends of the first strap. The first engagement ring is located between the first connecting ring and one of the two coupling rings. The second engagement ring is located between the first connecting ring and another of the two coupling rings. A second strap is length-adjustably coupled to the first strap to form a loop. The second strap includes two ends and inner and outer faces opposite to each other and extending between the two ends of the second strap. The second strap further includes two first fixing portions disposed on the outer face of the second strap and respectively located on the two ends of the second strap. The second strap further includes a second fixing portion disposed on the outer face of the second strap and located between the two first fixing portions. The second strap further includes a connecting ring fixed to the outer face of the second strap. Each of the two first fixing portions of the second strap extends around one of the two coupling rings and is detachably coupled to the second fixing portion. An upper strap device is length-adjustably coupled to the loop formed by the first and second straps. The upper strap device includes a first connecting strap and an upper buckle fixed to the first connecting strap. The first connecting strap includes two first connecting portions respectively disposed on two ends of the first connecting strap and a second connecting portion located between the two first connecting portions of the first connecting strap. One of the two first connecting portions of the first connecting strap extends around the first connecting ring of the first strap and is detachably coupled with the second connecting portion of the first connecting strap. The other of the two first connecting portions of the first connecting strap extends around the connecting ring of the second strap and is detachably coupled with the second connecting portion of the first connecting strap. A lower strap is length-adjustably coupled to the first strap. The lower strap includes two ends and inner and outer faces opposite to each other and extending between the inner and outer faces of the lower strap. The lower strap further includes two first engagement portions disposed on the outer face of the lower strap and two second engagement portions disposed on the outer face of the lower strap and located between the two first engagement portions. The two first engagement portions respectively extend around the first and second engagement rings of the first strap and are detachably coupled to the second engagement portion of the lower strap. The first and second straps are located between the upper strap device and the lower strap.

In a first aspect of the present invention, the headgear further includes a first rehabilitation accessory having a first cord and a first hook attached to an end of the first cord. The headgear further includes a weight training accessory having a connecting string having two ends, two coupling members respectively fixed to the two ends of the connecting string, and a weight disposed at an intermediate portion of the connecting string. When the headgear is assembled to be in a rehabilitation mode, the first hook is detachably coupled to one of the first buckle and the upper buckle. When the headgear is assembled to be in a weight training mode, the two coupling members of the weight training accessory are detachably engaged with the first buckle.

The headgear can further include a second rehabilitation accessory having a second cord, a coupling member fixed to a first end of the second cord, and a handle fixed to a second end of the second cord. When the headgear is assembled to be in the rehabilitation mode, the coupling member of the second rehabilitation accessory is selectively and detachably coupled to the first buckle, and the first rehabilitation accessory is selectively detached from the upper buckle.

Each of the first and second cords can be an elastic cord.

The first strap can further include second and third buckles fixed to the outer face of the first strap. The first buckle is located between the second and third buckles. The second strap can further include a coupling ring fixed to the outer face of the second strap. When the headgear is assembled to be in the rehabilitation mode, the coupling member of the second rehabilitation accessory is selectively and detachably coupled to one of the first buckle, the second buckle, the third buckle, and the coupling ring. When the headgear is assembled to be in the weight training mode, the two connecting rings of the weight training accessory are selectively engaged with the second buckle and the third buckle and selectively disengaged from the first buckle.

The first strap can further include second and third buckles fixed to the outer face of the first strap. The first buckle is located between the second and third buckles. The second strap can further include a coupling ring fixed to the outer face of the second strap. When the headgear is assembled to be in the rehabilitation mode, the first hook of the first rehabilitation accessory is selectively and detachably coupled to one of the first buckle, the second buckle, the third buckle, and the upper buckle. When the headgear is assembled to be in the weight training mode, the two coupling members of the weight training accessory are selectively engaged with the second buckle and the third buckle and selectively disengaged from the first buckle.

The upper strap device can further include a second connecting strap having an intermediate portion fixed to an intermediate portion of the first connecting strap. The first and second connecting straps form a crisscross. The upper buckle is disposed on an intersection of the intermediate portions of the first and second connecting straps. The second connecting strap includes two first connecting portions respectively disposed on two ends of the second connecting strap and a second connecting portion disposed between the two first connecting portions of the second connecting strap. The first strap further includes second and third connecting rings fixed to the outer face of the first strap. The first connecting ring is located between the second and third connecting rings. One of the two first connecting portions of the second connecting strap extends around the second connecting ring of the first strap and is detachably coupled with the second connecting portion of the second connecting strap. The other of the two first connecting portions of the second connecting strap extends around the third connecting ring of the first strap and is detachably coupled with the second connecting portion of the second connecting strap.

In a second aspect of the present invention, the headgear further includes a first rehabilitation accessory having a first cord and a first hook attached to an end of the first cord. The first hook of the first rehabilitation accessory is selectively and detachably coupled to one of the first buckle and the upper buckle.

In a third aspect of the present invention, the headgear further includes a weight training accessory having a connecting string having two ends and two coupling members fixed to the two ends of the connecting string, and a weight. The two coupling members of the weight training accessory are detachably coupled to the first buckle.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
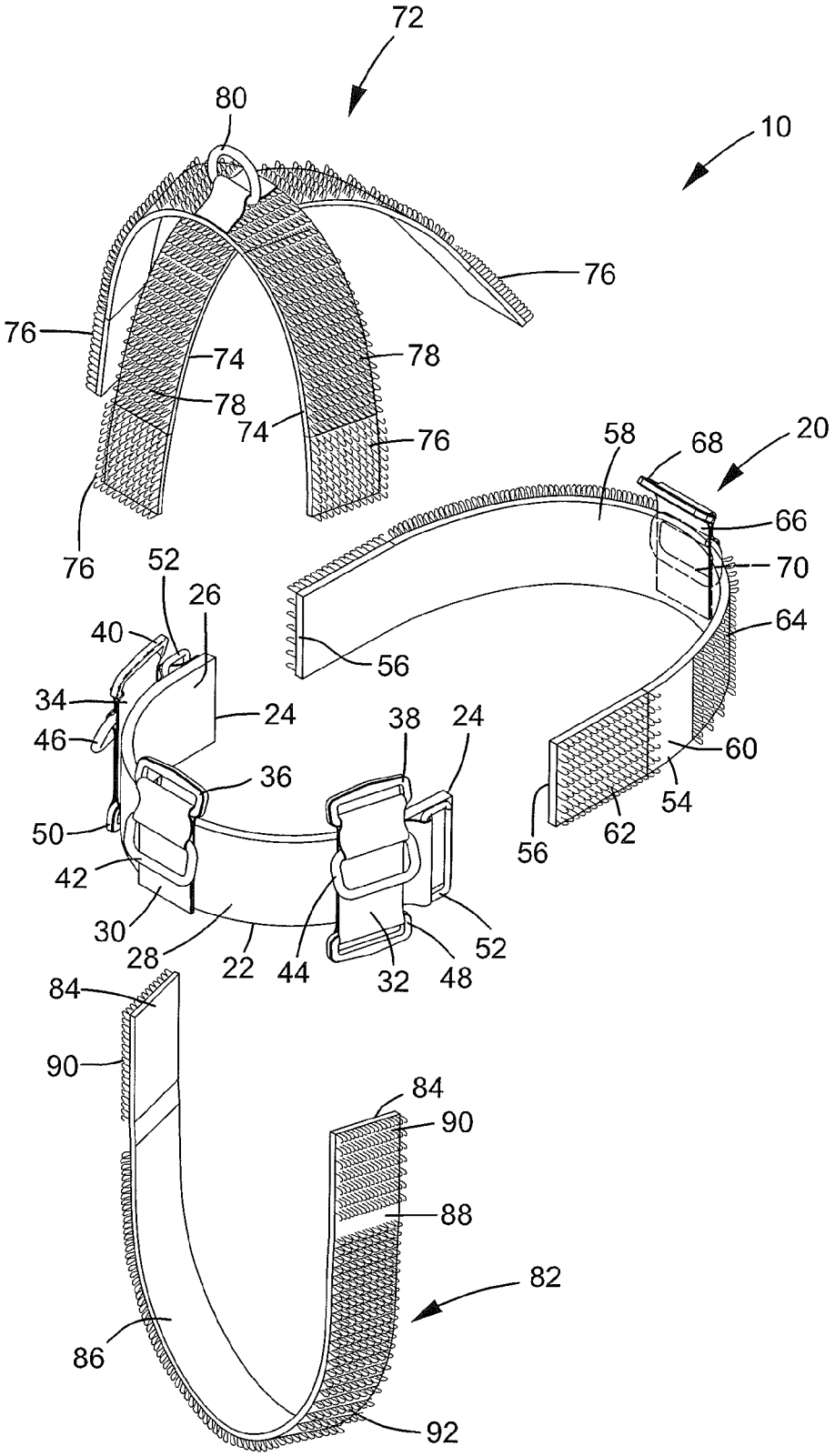
FIG. 1 is an exploded, perspective view of a headgear according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "top", "rear", "side", "end", "portion", "section", "spacing", "length", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

A headgear is shown in the drawings and generally designated 10. Headgear 10 includes an intermediate fixing portion 20 having a first strap 22 and a second strap 54 length-adjustably coupled to the first strap 22 to form a loop. The first strap 22 includes two connecting ends 24 and inner and outer faces 26 and 28 opposite to each other and extending between the two connecting ends 24. The head strap 22 further includes first, second, and third fixing sections 30, 32, and 34 disposed on the outer face 28. The first fixing section 30 is located between the second and third fixing sections 32 and 34 that are respectively located adjacent to the two connecting ends 24.

A first connecting ring 36 and a first buckle 42 are fixed to the first fixing section 30. A second connecting ring 38, a second buckle 44, and a first engagement ring 48 are fixed to the second fixing section 32. The second buckle 44 is located between the second connecting ring 38 and the first engagement ring 48. A third connecting ring 40, a third buckle 46, and a second engagement 50 are fixed to the third fixing section 34. The first buckle 42 is located between the second and third buckles 44 and 46. The first connecting ring 36 is located between the second and third connecting rings 38 and 40. The two coupling rings 52 are respectively fixed to the two connecting ends 24 of the first strap 22.

The second strap 54 includes two ends 56 and inner and outer faces 58 and 60 opposite to each other and extending between the two ends 56 of the second strap 54. The second strap 54 further includes two first fixing portions 62 disposed on the outer face 60 of the second strap 54 and respectively located on the two ends 56 of the second strap 54. The second strap 54 further includes a second fixing portion 64 disposed on the outer face 60 of the second strap 54 and located between the two first fixing portions 62. Each first fixing portion 62 can be one of a hook tape (having a plurality of hooks on a side thereof) and a loop tape (having a plurality of loops on a side thereof). The second fixing portion 64 can be the other of the hook tape and the loop tape. The outer face 60 of the second strap 54 further includes an interconnecting portion 66. Furthermore, a connecting ring 68 and a coupling ring 70 are fixed to the interconnecting portion 66 of the second strap 54.

Figure 2:
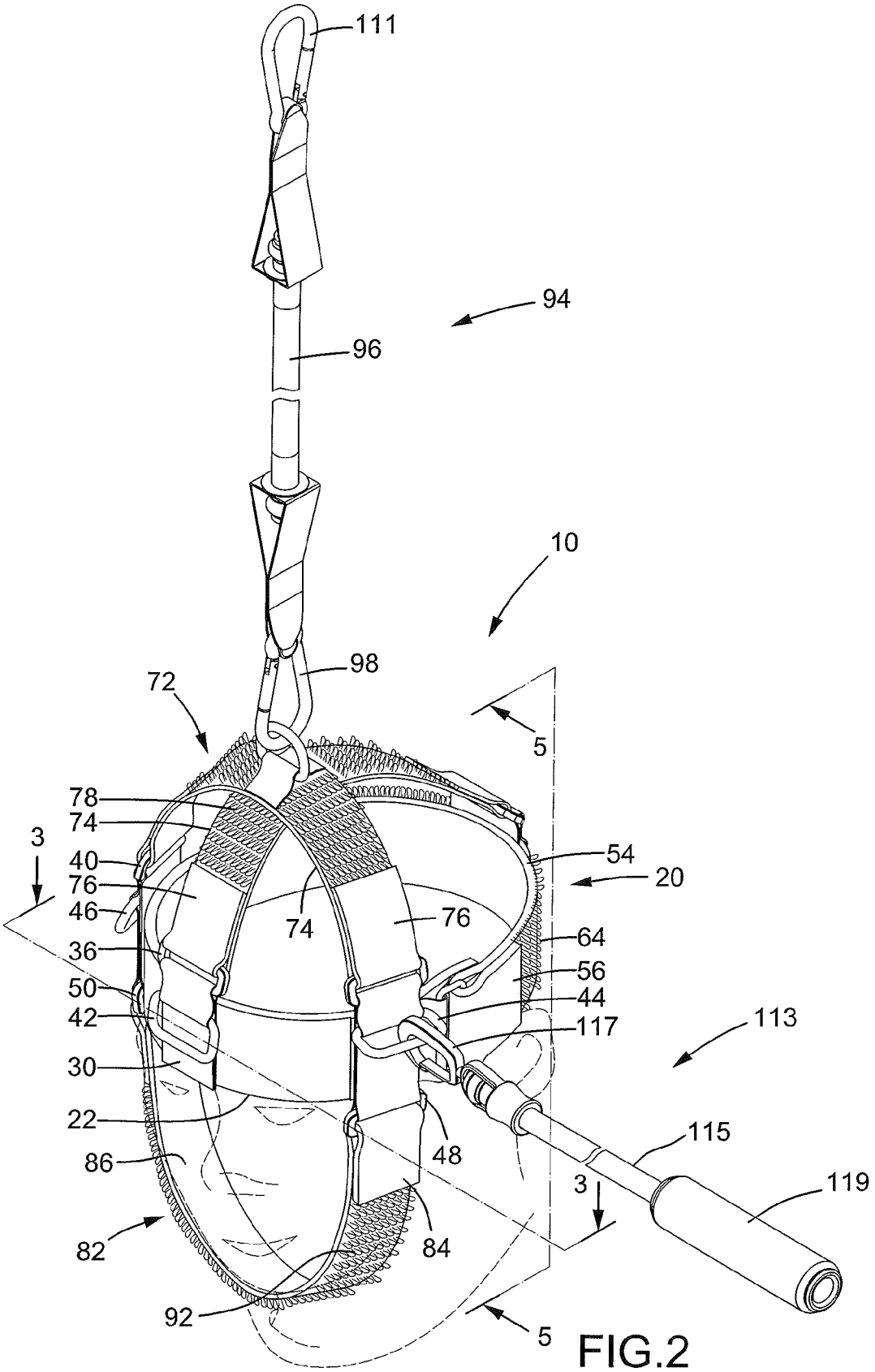
FIG. 2 is a perspective view of the headgear according to the present invention.
Figure 3:
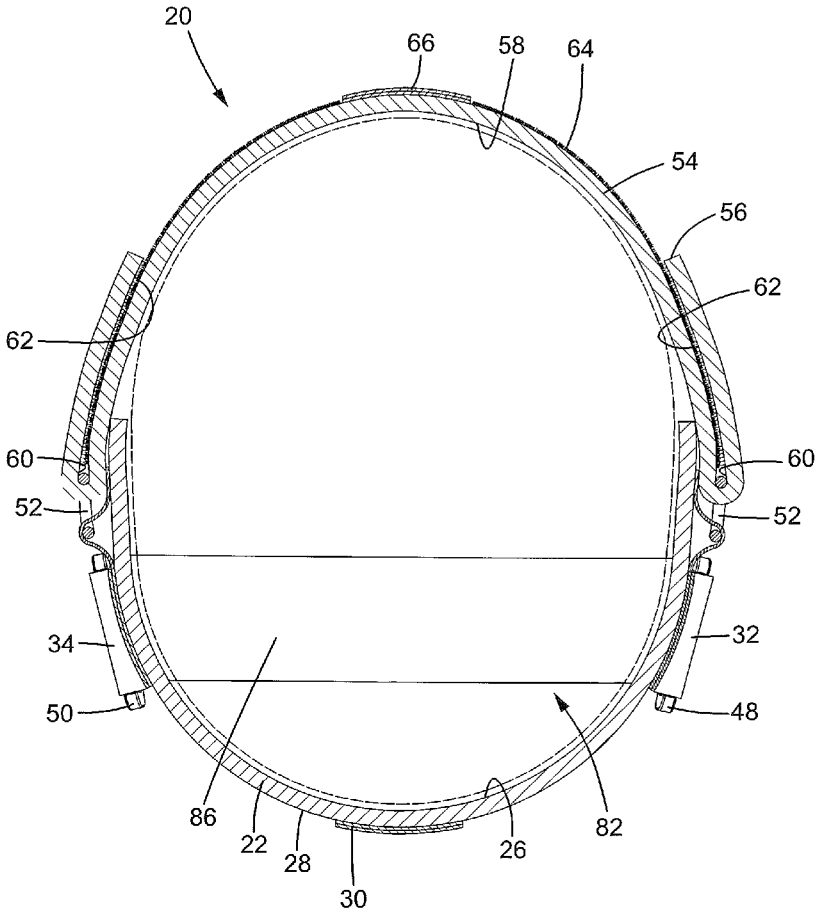
FIG. 3 is a cross sectional view taken along section line 3-3 of FIG. 2.

Each of the two first fixing portions 62 of the second strap 54 extends through one of the two coupling rings 52, is folded back, and is detachably coupled to the second fixing portion 64 (FIGS. 2 and 3). Namely, each first fixing portion 62 of the second strap 54 extends around one of the two coupling rings 52 before coupling with the second fixing portion 64. Thus, the first and second straps 22 and 54 form the intermediate fixing portion 20 in the form of a loop.

The headgear 10 further includes an upper strap device 72 length-adjustably coupled to the loop formed by the first and second straps 22 and 54. The upper strap device 72 includes first and second connecting straps 74 connected to each other to form a crisscross. Each of the first and second connecting straps 74 includes two first connecting portions 76 respectively disposed on two ends thereof and a second connecting portion 78 located between the two first connecting portions 76. An upper buckle 80 is disposed on an intersection of the intermediate portions of the first and second connecting straps 74. Each first connecting portion 76 can be one of a hook tape (having a plurality of hooks on a side thereof) and a loop tape (having a plurality of loops on a side thereof). The second connecting portion 78 can be the other of the hook tape and the loop tape.

With reference to FIG. 2, one of the two first connecting portions 76 of the first connecting strap 74 extends through the first connecting ring 36 of the first strap 22, is folded back, and is detachably coupled with the second connecting portion 78 of the first connecting strap 74. The other of the two first connecting portions 76 of the first connecting strap 74 extends through the connecting ring 68 of the second strap 54, is folded back, and is detachably coupled with the second connecting portion 78 of the first connecting strap 74.

With reference to FIG. 2, one of the two first connecting portions 76 of the second connecting strap 74 extends through the second connecting ring 38 of the first strap 22, is folded back, and is detachably coupled with the second connecting portion 78 of the second connecting strap 74. The other of the two first connecting portions 76 of the second connecting strap 74 extends through the third connecting ring 40 of the first strap 22, is folded back, and is detachably coupled with the second connecting portion 78 of the second connecting strap 74.

The headgear 10 further includes a lower strap 82 length-adjustably coupled to the first strap 22. The lower strap 82 includes two ends 84 and inner and outer faces 86 and 88 opposite to each other and extending between the inner and outer faces 86 and 88 of the lower strap 82. The lower strap 82 further includes two first engagement portions 90 disposed on the outer face 88 of the lower strap 82 and two second engagement portions 92 disposed on the outer face 88 of the lower strap 82 and located between the two first engagement portions 90. Each first engagement portion 90 can be one of a hook tape (having a plurality of hooks on a side thereof) and a loop tape (having a plurality of loops on a side thereof). The second engagement portion 94 can be the other of the hook tape and the loop tape.

With reference to FIG. 2, the two first engagement portions 90 of the lower strap 82 respectively extend through the first and second engagement rings 48 and 50 of the first strap 22 and are detachably coupled to the second engagement portion 92 of the lower strap 82. The first and second straps 22 and 54 are located between the upper strap device 72 and the lower strap 82.

To provide a rehabilitation function, the headgear 10 further includes a first rehabilitation accessory 94 and a second rehabilitation accessory 113. The first rehabilitation accessory 94 includes a first cord 96, a first hook 98 attached to an end of the first cord 96, and a second hook 111 attached to the other end of the first cord 96. The second rehabilitation accessory 113 includes a second cord 115 having first and second ends, a coupling member 117 fixed to the first end of the second cord 115, and a handle 119 fixed to the second end of the second cord 115.

To provide a weight training function, the headgear further includes a weight training accessory 131. The weight training accessory 131 includes a connecting string 132 having two ends, two coupling members 133 respectively fixed to the two ends of the connecting string 132, and a weight 135 disposed at an intermediate portion of the connecting string 132.

Figure 4:
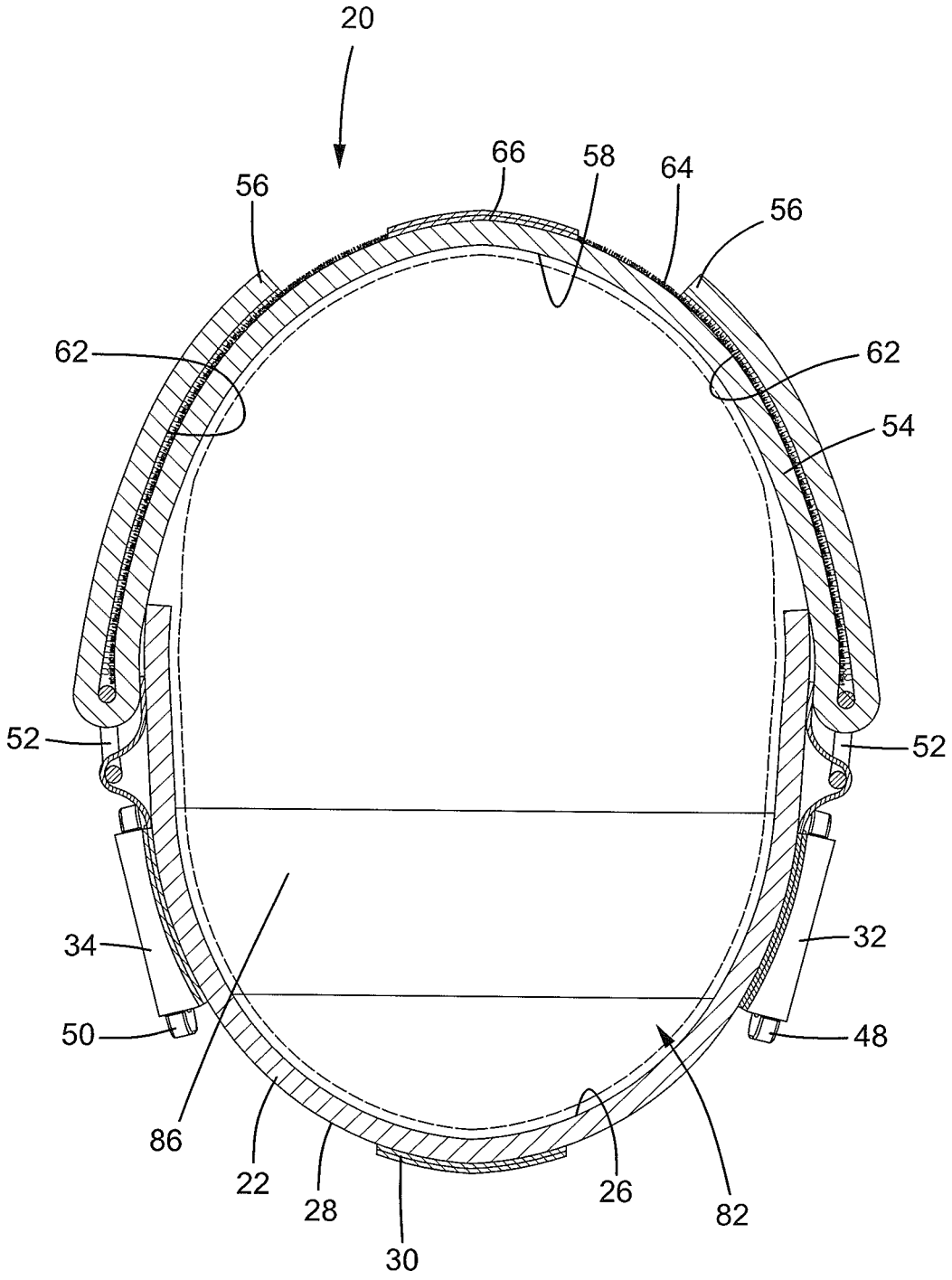
FIG. 4 is a view similar to FIG. 3, with the headgear adjusted to fit a user having a smaller head circumference.

In use, the headgear 10 is worn on a head of a user (FIG. 2), the intermediate fixing portion 20 wraps the forehead of the user, the inner face 26 of the first strap 22 abuts the forehead of the user, and the inner face 58 of the second strap 54 abuts the rear of the head of the user. The user can adjust the length of the second strap 54 according to the head circumference of the user. With reference to FIG. 3, for a user having a larger head circumference, the folded section of each first fixing portion 62 of the second strap 54 is shorter, such that the inner diameter of the intermediate fixing portion 20 formed by the first and second straps 22 and 54 is larger for the user having a larger head circumference. With reference to FIG. 4, for a user having a smaller head circumference, the folded section of each first fixing portion 62 of the second strap 54 is longer, such that the inner diameter of the intermediate fixing portion 20 formed by the first and second straps 22 and 54 is smaller for the user having a smaller head circumference.

Figure 5:
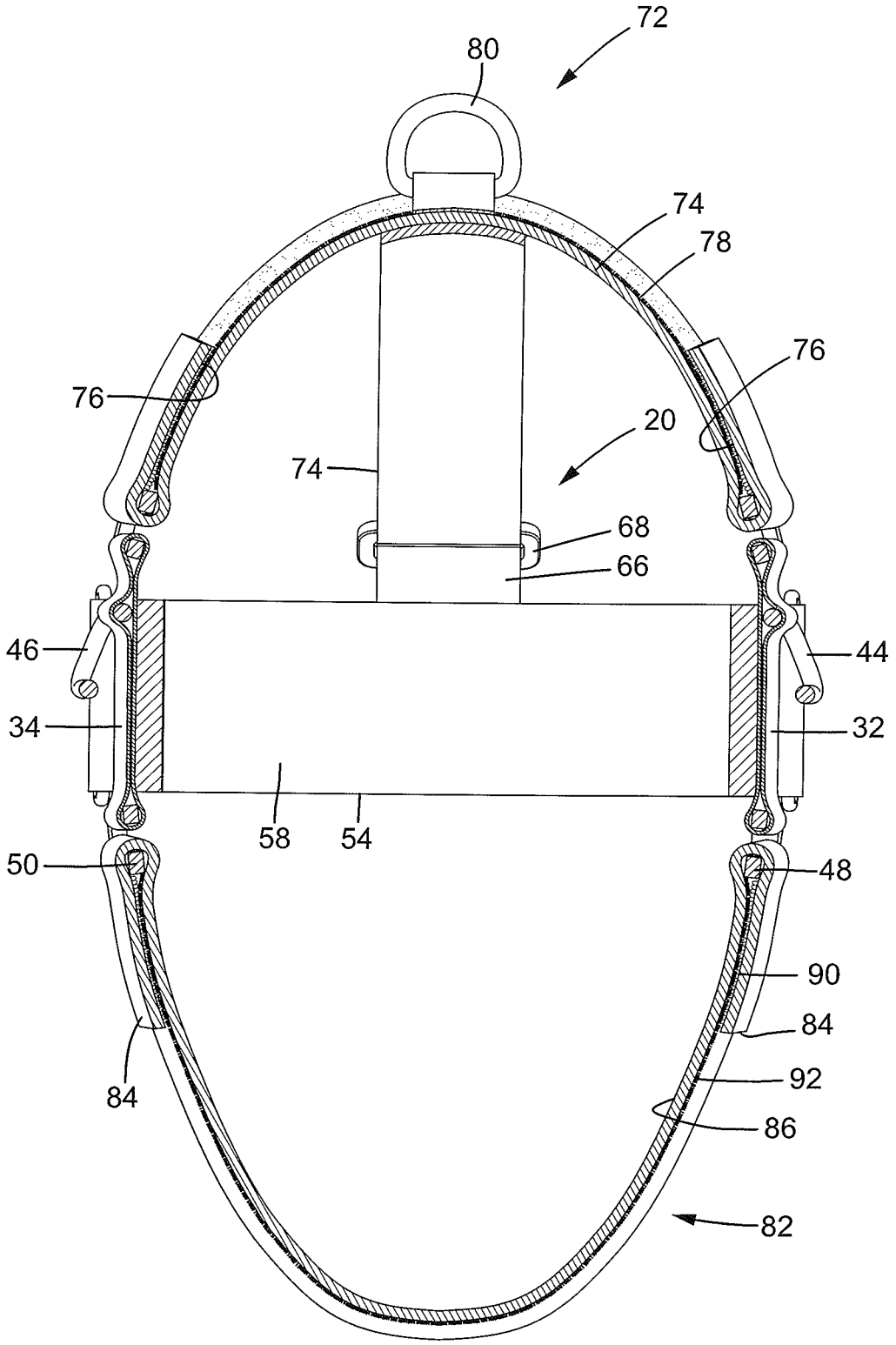
FIG. 5 is a cross sectional view taken along section line 5-5 of FIG. 2.
Figure 6:
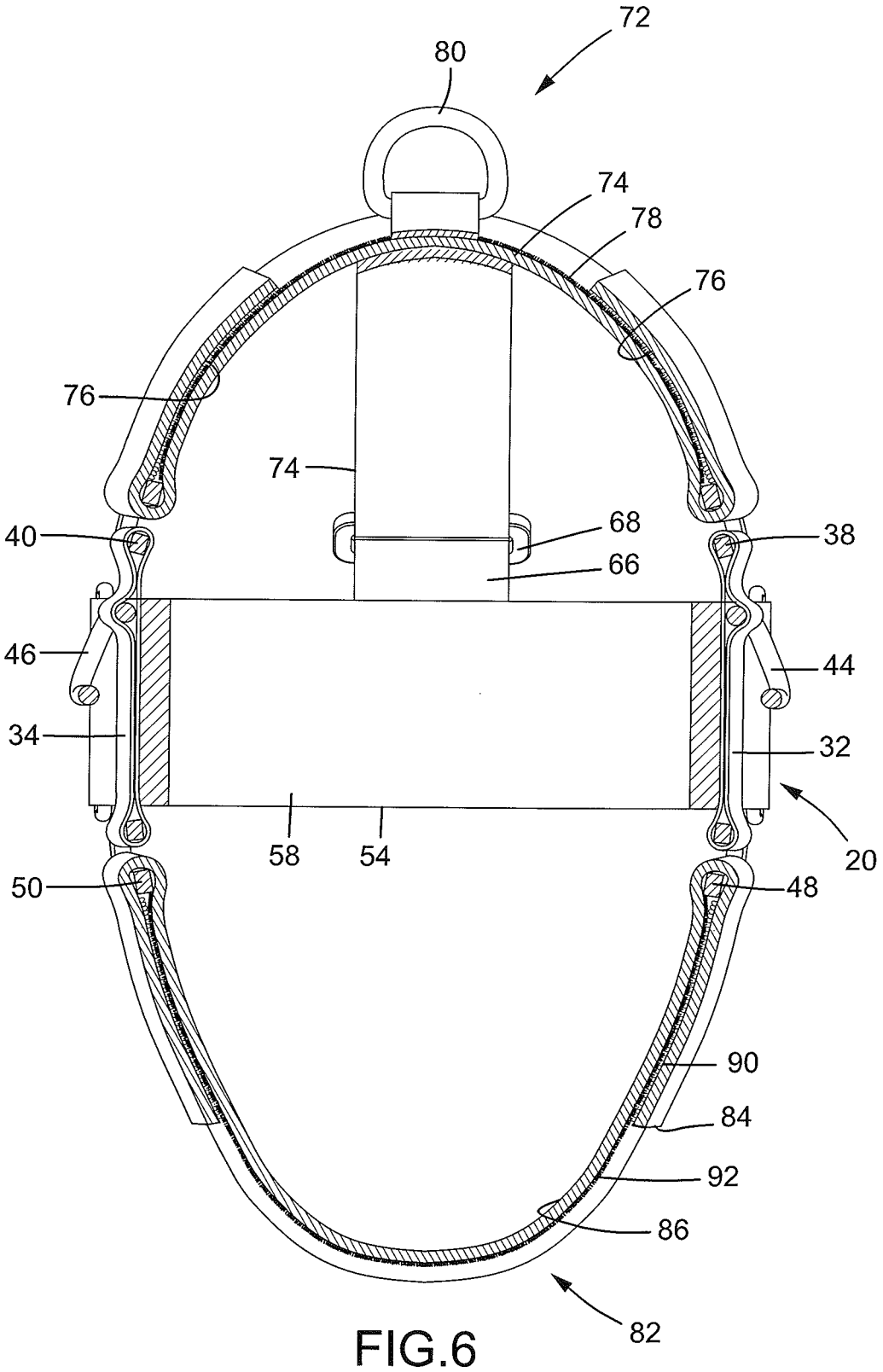
FIG. 6 is a view similar to FIG. 5, with the headgear adjusted to suit a user having a smaller chin or a smaller face.

The upper strap device 72 abuts the top of the head of the user. The lower strap 82 abuts the chin of the user. The upper strap device 72 can be adjusted according to the length from the forehead to the top of the head of the user. Specifically, in a case that the length from the forehead to the top of the head of the user is larger, the folded section of each first connecting portion 76 of each first connecting strap 74 is shorter (FIG. 5). In another case that the length from the forehead to the top of the head of the user is smaller, the folded section of each first connecting portion 76 of each first connecting strap 74 is longer (FIG. 6).

The length of the lower strap 82 can be adjusted according to the sizes of the chin and the face of the user. Specifically, in a case that the chin or the face of the user is larger, the folded section of each first engagement portion 90 of the lower strap 82 is shorter (FIG. 5). In another case that the chin or the face of the user is smaller, the folded section of each first engagement portion 90 of the lower strap 82 is longer (FIG. 6).

Figure 7:
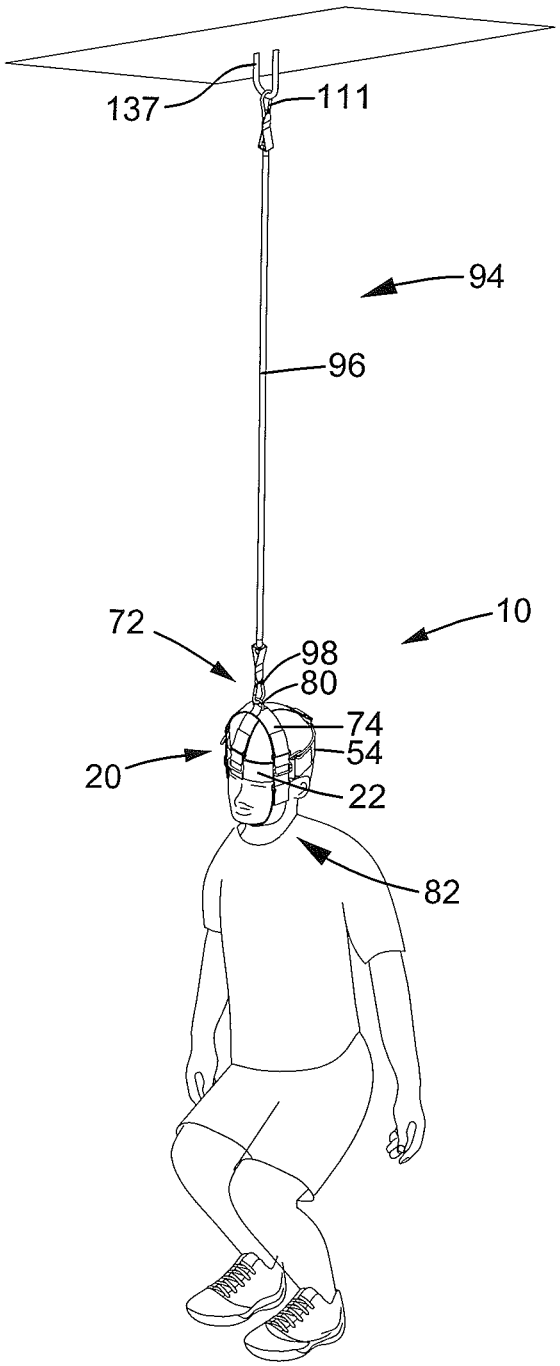
FIG. 7 is a diagrammatic view illustrating use of the headgear in a rehabilitation mode by using a first rehabilitation accessory.
Figure 8:
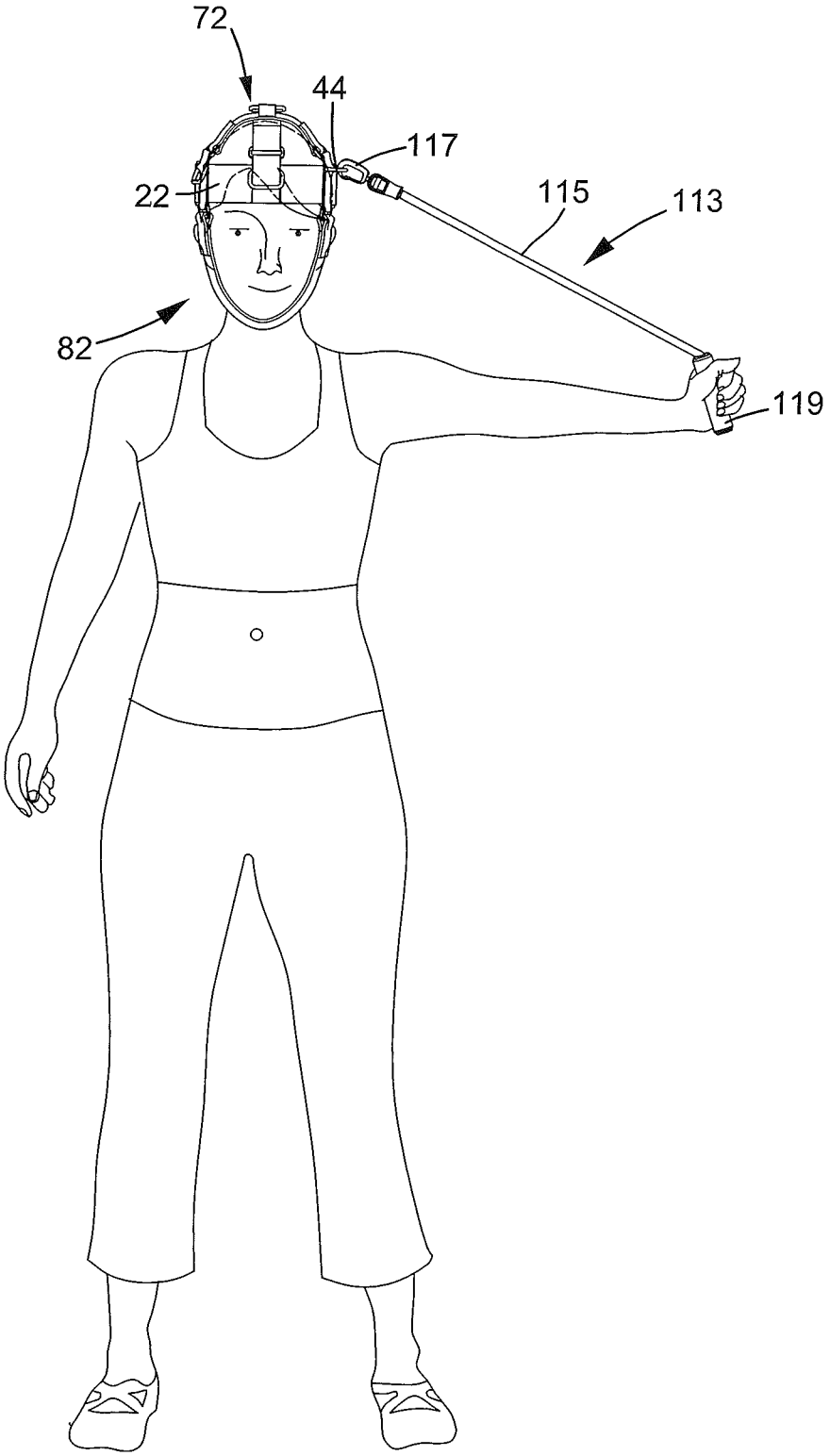
FIG. 8 is a diagrammatic view illustrating use of the headgear in the rehabilitation mode by using a second rehabilitation accessory.

The headgear 10 can be assembled to be in a neck rehabilitation mode or a neck weight training mode. When the headgear 10 is assembled to be in the rehabilitation mode, the first rehabilitation accessory 94 or the second rehabilitation accessory 113 can be used. If the first rehabilitation accessory 94 is used, the first hook 98 of the first rehabilitation accessory 94 is detachably coupled to the first buckle 42, the second buckle 44, the third buckle 46, the coupling ring 70, or the upper buckle 80. The user can pull the second hook 111 with one hand and can fight against the elasticity of the first cord 96, achieving a neck rehabilitation effect. In an example, the first hook 98 is coupled with the upper buckle 80, and the second hook 111 is coupled with a ring 137 fixed to a roof (FIG. 7). Thus, the user can stretch the first cord 96 by semi-squatting. The elasticity of the first cord 96 provides a rehabilitation effect for the cervical vertebra of the user.

If the headgear 10 is assembled to be in the weight training mode by using the second rehabilitation accessory 113, the coupling member 117 of the second rehabilitation accessory 113 is detachably coupled to the first buckle 42, the second buckle 44, the third buckle 46, the coupling ring 70, or the upper buckle 80. In an example shown in FIGS.

2 and 8, the coupling member 117 can be engaged with the second buckle 44, and the user can hold the handle 119 and stretch the second cord 115. The neck of the user can obtain a rehabilitation effect by fighting against the elasticity of the second cord 115.

Figure 9:
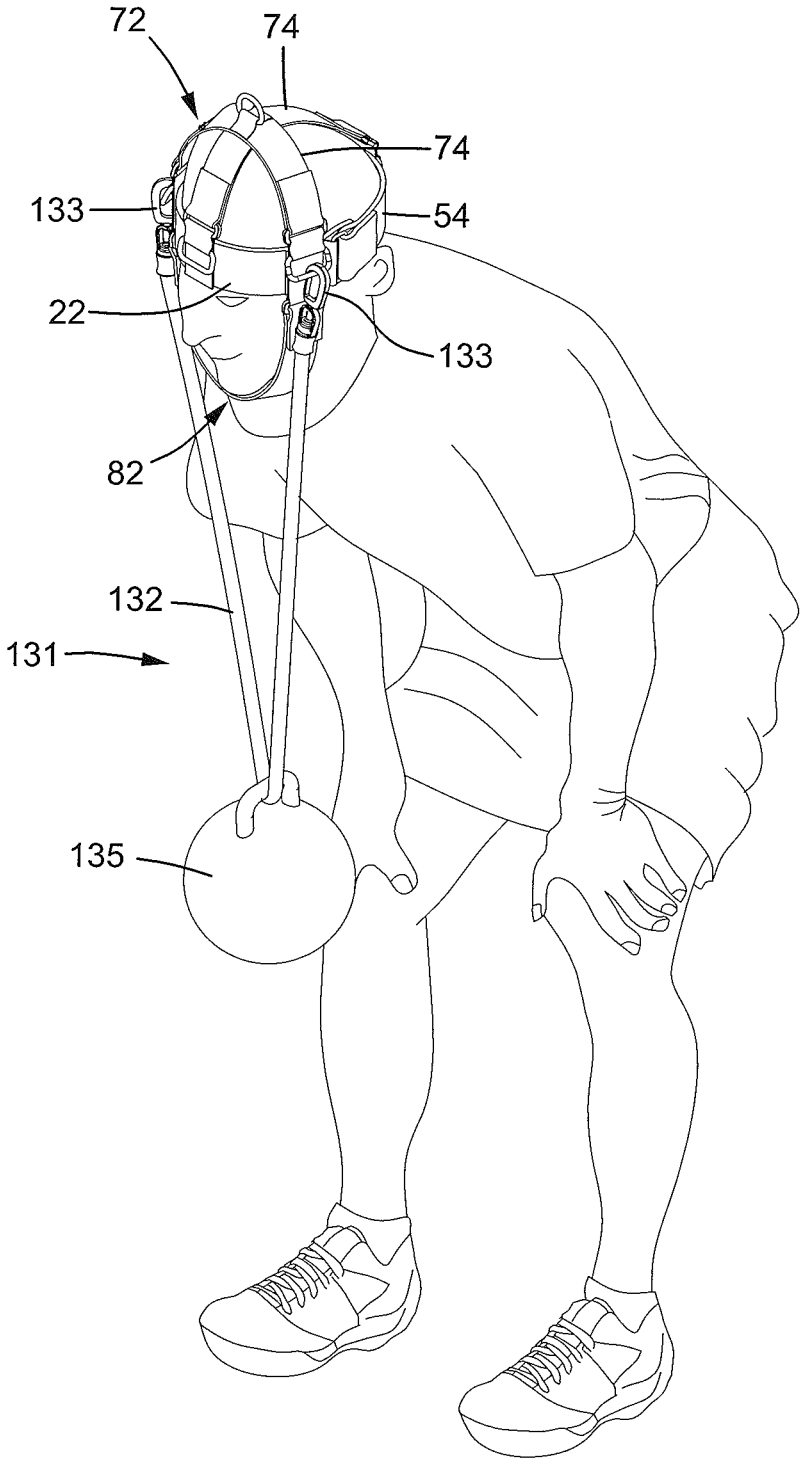
FIG. 9 is a diagrammatic view illustrating use of the headgear in a weight training mode by using a weight training accessory.

If it is desired to use the headgear 10 to proceed with weight training of the neck of the user, the weight training accessory 131 is coupled with the headgear 10. Specifically, the two coupling members 133 of the weight training accessory 131 are engaged with one or two of the first buckle 42, the second buckle 44, the third buckle 46, and the coupling ring 70. In an example shown in FIG. 9, the two coupling members 133 of the weight training accessory 131 are engaged with the second buckle 44 and the third buckle 46 to proceed with weight training of the neck.

The headgear 10 can provide the user with different neck rehabilitation functions by using the first rehabilitation accessory 94 and the second rehabilitation accessory 113. Furthermore, the headgear 10 can couple with the weight training accessory 131 to provide a weight training function.

The first cord 96 and the second cord 115 can be elastic cords to avoid injury to the neck of the user resulting from an excessive force applied by the user, increasing use safety.

The upper strap device 72 of the headgear 10 can be adjusted according to the length from the forehead to the top of the head of the user, such that the headgear 10 are suitable for users of different head shapes.

The second strap 54 can be adjusted according to the head circumference of the user, such that the headgear 10 are suitable for users of different head circumferences.

The lower strap 82 can be adjusted according to the length of the chin and the face of the user, such that the headgear 10 are suitable for users of different chins and faces.

Now that the basic teachings of the present invention have been explained, many extensions and variations will be obvious to one having ordinary skill in the art. For example, the upper strap device 72 can include only one connecting strap 74 that is length-adjustably coupled with the first connecting ring 36 and the connecting ring 68 or the second and third connecting rings 38 and 40. Furthermore, the first cord 96 of the first rehabilitation accessory 94 can be a cord without elasticity without adversely affecting the rehabilitation effect.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A headgear comprising:

a first strap including two connecting ends and inner and outer faces opposite to each other and extending between the two connecting ends, with the first strap further including a first connecting ring fixed to the outer face, a first buckle fixed to the outer face, and first and second engagement rings and fixed to the outer face and located on two sides of the first buckle, with the first strap further including two coupling rings respectively fixed to the two connecting ends of the first strap, with the first engagement ring located between the first connecting ring and one of the two coupling rings, and with the second engagement ring located between the first connecting ring and another of the two coupling rings;

a second strap length-adjustably coupled to the first strap to form a loop, with the second strap including two ends and inner and outer faces opposite to each other and extending between the two ends of the second strap, with the second strap further including two first fixing portions disposed on the outer face of the second strap and respectively located on the two ends of the second strap, with the second strap further including a second fixing portion disposed on the outer face of the second strap and located between the two first fixing portions, with the second strap further including a connecting ring fixed to the outer face of the second strap, and with each of the two first fixing portions of the second strap extending around one of the two coupling rings and detachably coupled to the second fixing portion;

an upper strap device length-adjustably coupled to the loop formed by the first and second straps, with the upper strap device including a first connecting strap and an upper buckle fixed to the first connecting strap, with the first connecting strap including two first connecting portions respectively disposed on two ends of the first connecting strap and a second connecting portion located between the two first connecting portions of the first connecting strap, with one of the two first connecting portions of the first connecting strap extending around the first connecting ring of the first strap and detachably coupled with the second connecting portion of the first connecting strap, and with another of the two first connecting portions of the first connecting strap extending around the connecting ring of the second strap and detachably coupled with the second connecting portion of the first connecting strap;

a lower strap length-adjustably coupled to the first strap, with the lower strap including two ends and inner and outer faces opposite to each other and extending between the inner and outer faces of the lower strap, with the lower strap further including two first engagement portions disposed on the outer face of the lower strap and two second engagement portions disposed on the outer face of the lower strap and located between the two first engagement portions, with the two first engagement portions respectively extending around the first and second engagement rings of the first strap and detachably coupled to the second engagement portion of the lower strap, and with the first and second straps located between the upper strap device and the lower strap;

a first rehabilitation accessory including a first cord and a first hook attached to an end of the first cord; and a weight training accessory including a connecting string having two ends, two coupling members respectively fixed to the two ends of the connecting string, and a weight disposed at an intermediate portion of the connecting string, wherein with the headgear assembled to be in a rehabilitation mode, the first hook is detachably coupled to one of the first buckle and the upper buckle, and wherein with the headgear assembled to be in a weight training mode, the two coupling members of the weight training accessory are detachably engaged with the first buckle.

2. The headgear as claimed in claim 1, further comprising:

a second rehabilitation accessory including a second cord having first and second ends, a coupling member fixed to the first end of the second cord, and a handle fixed to the second end of the second cord, wherein with the headgear assembled to be in the rehabilitation mode, the coupling member of the second rehabilitation accessory is selectively and detachably coupled to the first buckle, and the first rehabilitation accessory is selectively detached from the upper buckle.

3. The headgear as claimed in claim 2, wherein each of the first and second cords is an elastic cord.

4. The headgear as claimed in claim 2, with the first strap further including second and third buckles fixed to the outer face of the first strap, with the first buckle located between the second and third buckles, and with the second strap further including a coupling ring fixed to the outer face of the second strap, wherein with the headgear assembled to be in the rehabilitation mode, the coupling member of the second rehabilitation accessory is selectively and detachably coupled to one of the first buckle, the second buckle, the third buckle, and the coupling ring, and wherein with the headgear assembled to be in the weight training mode, the two connecting rings of the weight training accessory are selectively engaged with the second buckle and the third buckle and selectively disengaged from the first buckle.

5. The headgear as claimed in claim 1, with the first strap further including second and third buckles fixed to the outer face of the first strap, with the first buckle located between the second and third buckles, and with the second strap further including a coupling ring fixed to the outer face of the second strap, wherein with the headgear assembled to be in the rehabilitation mode, the first hook of the first rehabilitation accessory is selectively and detachably coupled to one of the first buckle, the second buckle, the third buckle, and the upper buckle, and wherein with the headgear assembled to be in the weight training mode, the two coupling members of the weight training accessory are selectively engaged with the second buckle and the third buckle and selectively disengaged from the first buckle.

6. The headgear as claimed in claim 1, with the upper strap device further including a second connecting strap having an intermediate portion fixed to an intermediate portion of the first connecting strap, with the first and second connecting straps forming a crisscross, with the upper buckle disposed on an intersection of the intermediate portions of the first and second connecting straps, with the second connecting strap including two first connecting portions respectively disposed on two ends of the second connecting strap and a second connecting portion disposed between the two first connecting portions of the second connecting strap, with the first strap further including second and third connecting rings fixed to the outer face of the first strap, with the first connecting ring located between the second and third connecting rings, with one of the two first connecting portions of the second connecting strap extending around the second connecting ring of the first strap and detachably coupled with the second connecting portion of the second connecting strap, with another of the two first connecting portions of the second connecting strap extending around the third connecting ring of the first strap and detachably coupled with the second connecting portion of the second connecting strap.

7. A headgear comprising:

a first strap including two connecting ends and inner and outer faces opposite to each other and extending between the two connecting ends, with the first strap further including a first connecting ring fixed to the outer face, a first buckle fixed to the outer face, and first and second engagement rings and fixed to the outer face and located on two sides of the first buckle, with the first strap further including two coupling rings respectively fixed to the two connecting ends of the first strap, with the first engagement ring located between the first connecting ring and one of the two coupling rings, and with the second engagement ring located between the first connecting ring and another of the two coupling rings;

a second strap length-adjustably coupled to the first strap to form a loop, with the second strap including two ends and inner and outer faces opposite to each other and extending between the two ends of the second strap, with the second strap further including two first fixing portions disposed on the outer face of the second strap and respectively located on the two ends of the second strap, with the second strap further including a second fixing portion disposed on the outer face of the second strap and located between the two first fixing portions, with the second strap further including a connecting ring fixed to the outer face of the second strap, and with each of the two first fixing portions of the second strap extending around one of the two coupling rings and detachably coupled to the second fixing portion;

an upper strap device length-adjustably coupled to the loop formed by the first and second straps, with the upper strap device including a first connecting strap and an upper buckle fixed to the first connecting strap, with the first connecting strap including two first connecting portions respectively disposed on two ends of the first connecting strap and a second connecting portion located between the two first connecting portions of the first connecting strap, with one of the two first connecting portions of the first connecting strap extending around the first connecting ring of the first strap and detachably coupled with the second connecting portion of the first connecting strap, and with another of the two first connecting portions of the first connecting strap extending around the connecting ring of the second strap and detachably coupled with the second connecting portion of the first connecting strap;

a lower strap length-adjustably coupled to the first strap, with the lower strap including two ends and inner and outer faces opposite to each other and extending between the inner and outer faces of the lower strap, with the lower strap further including two first engagement portions disposed on the outer face of the lower strap and two second engagement portions disposed on the outer face of the lower strap and located between the two first engagement portions, with the two first engagement portions respectively extending around the first and second engagement rings of the first strap and detachably coupled to the second engagement portion of the lower strap, and with the first and second straps located between the upper strap device and the lower strap; and a first rehabilitation accessory including a first cord and a first hook attached to an end of the first cord, with the first hook of the first rehabilitation accessory selectively and detachably coupled to one of the first buckle and the upper buckle.

8. The headgear as claimed in claim 7, with the upper strap device further including a second connecting strap having an intermediate portion fixed to an intermediate portion of the first connecting strap, with the first and second connecting straps forming a crisscross, with the upper buckle disposed on an intersection of the intermediate portions of the first and second connecting straps, with the second connecting strap including two first connecting portions respectively disposed on two ends of the second connecting strap and a second connecting portion disposed between the two first connecting portions of the second connecting strap, with the first strap further including second and third connecting rings fixed to the outer face of the first strap, with the first connecting ring located between the second and third connecting rings, with one of the two first connecting portions of the second connecting strap extending around the second connecting ring of the first strap and detachably coupled with the second connecting portion of the second connecting strap, with another of the two first connecting portions of the second connecting strap extending around the third connecting ring of the first strap and detachably coupled with the second connecting portion of the second connecting strap.

9. A headgear comprising:

a first strap including two connecting ends and inner and outer faces opposite to each other and extending between the two connecting ends, with the first strap further including a first connecting ring fixed to the outer face, a first buckle fixed to the outer face, and first and second engagement rings fixed to the outer face and located on two sides of the first buckle, with the first strap further including two coupling rings respectively fixed to the two connecting ends of the first strap, with the first engagement ring located between the first connecting ring and one of the two coupling rings, and with the second engagement ring located between the first connecting ring and another of the two coupling rings;

a second strap length-adjustably coupled to the first strap to form a loop, with the second strap including two ends and inner and outer faces opposite to each other and extending between the two ends of the second strap, with the second strap further including two first fixing portions disposed on the outer face of the second strap and respectively located on the two ends of the second strap, with the second strap further including a second fixing portion disposed on the outer face of the second strap and located between the two first fixing portions, with the second strap further including a connecting ring fixed to the outer face of the second strap, and with each of the two first fixing portions of the second strap extending around one of the two coupling rings and detachably coupled to the second fixing portion;

an upper strap device length-adjustably coupled to the loop formed by the first and second straps, with the upper strap device including a first connecting strap and an upper buckle fixed to the first connecting strap, with the first connecting strap including two first connecting portions respectively disposed on two ends of the first connecting strap and a second connecting portion located between the two first connecting portions of the first connecting strap, with one of the two first connecting portions of the first connecting strap extending around the first connecting ring of the first strap and detachably coupled with the second connecting portion of the first connecting strap, and with another of the two first connecting portions of the first connecting strap extending around the connecting ring of the second strap and detachably coupled with the second connecting portion of the first connecting strap;

a lower strap length-adjustably coupled to the first strap, with the lower strap including two ends and inner and outer faces opposite to each other and extending between the inner and outer faces of the lower strap, with the lower strap further including two first engagement portions disposed on the outer face of the lower strap and two second engagement portions disposed on the outer face of the lower strap and located between the two first engagement portions, with the two first engagement portions respectively extending around the first and second engagement rings of the first strap and detachably coupled to the second engagement portion of the lower strap, and with the first and second straps located between the upper strap device and the lower strap; and a weight training accessory including a connecting string having two ends and two coupling members fixed to the two ends of the connecting string, and a weight, with the two coupling members of the weight training accessory detachably coupled to the first buckle.

10. The headgear as claimed in claim 9, with the upper strap device further including a second connecting strap having an intermediate portion fixed to an intermediate portion of the first connecting strap, with the first and second connecting straps forming a crisscross, with the upper buckle disposed on an intersection of the intermediate portions of the first and second connecting straps, with the second connecting strap including two first connecting portions respectively disposed on two ends of the second connecting strap and a second connecting portion disposed between the two first connecting portions of the second connecting strap, with the first strap further including second and third connecting rings fixed to the outer face of the first strap, with the first connecting ring located between the second and third connecting rings, with one of the two first connecting portions of the second connecting strap extending around the second connecting ring of the first strap and detachably coupled with the second connecting portion of the second connecting strap, with another of the two first connecting portions of the second connecting strap extending around the third connecting ring of the first strap and detachably coupled with the second connecting portion of the second connecting strap.

* * * * *